US005622157A

United States Patent [19]

Murata

[11] Patent Number: 5,622,157

[45] Date of Patent: Apr. 22, 1997

[54] IGNITION APPARATUS FOR INTERNAL COMBUSTION ENGINE AND MANUFACTURING METHOD THEREOF

[75] Inventor: Shigemi Murata, Tokyo, Japan

[73] Assignee: Mitsubishi Denki Kabushiki Kaisha, Tokyo, Japan

[21] Appl. No.: 659,835

[22] Filed: Jun. 7, 1996

[30] Foreign Application Priority Data

Jun. 9, 1995 [JP] Japan ..... 7-143519

[51] Int. Cl.[6] ..... F02P 3/12

[52] U.S. Cl. ..... 123/647

[58] Field of Search ..... 123/607, 613, 123/605, 634; 361/247, 388; 439/436, 527

[56] References Cited

U.S. PATENT DOCUMENTS

| | | | |
|---|---|---|---|
| 4,951,641 | 8/1990 | Takaishi et al. | 123/647 |
| 5,003,959 | 4/1991 | Umezaki et al. | 123/647 |
| 5,159,532 | 10/1992 | Kilian et al. | 361/388 |
| 5,296,999 | 3/1994 | Taruya | 361/247 |
| 5,355,865 | 10/1994 | Okamura | 123/613 |
| 5,365,909 | 11/1994 | Sawazaki et al. | 123/617 |
| 5,463,999 | 11/1995 | Taruya et al. | 123/647 |
| 5,558,074 | 9/1996 | Fukatsu et al. | 123/647 |

FOREIGN PATENT DOCUMENTS

| | | | |
|---|---|---|---|
| 4-77220 | 7/1992 | Japan | 123/647 |

*Primary Examiner*—Raymond A. Nelli

*Attorney, Agent, or Firm*—Sughrue, Mion, Zinn, Macpeak & Seas

[57] ABSTRACT

Disclosed is an ignition apparatus for an internal combustion engine which includes an insulation case accommodating a power switch 29 for intermittently feeding a primary current to an ignition coil, a heat sink 26 in contact with the power switch 29 for radiating heat generated by the power switch 29 and the primary coil 4 and the secondary coil of the ignition coil with the power switch 29, the heat sink 26, the primary coil 4 and the secondary coil being fixed by an insulating resin material poured into the insulation case, wherein the power switch 29 is elastically engaged with the heat sink 26. With this arrangement, there is provided an ignition apparatus for internal combustion engine capable of reducing a manufacturing cost as well as the size thereof.

10 Claims, 6 Drawing Sheets

IGNITION APPARATUS FOR INTERNAL COMBUSTION ENGINE AND MANUFACTURING METHOD THEREOF

BACKGROUND OF THE INVENTION

1. Field of the Invention

The present invention relates to an ignition apparatus for an internal combustion engine having a power switch for intermittently feeding a primary current to an ignition coil which is integrated with the power switch.

2. Description of the Related Art

FIG. 5 is a side elevational view of a conventional ignition apparatus for an internal combustion engine, FIG. 6 is a cross sectional view taken along line VI—VI of FIG. 5 and FIG. 7 is an electric circuit diagram of the ignition apparatus for the internal combustion engine. In these figures, a hole 1*b* is defined to the bottom of the accommodating section 1*a* of a synthetic resin insulating case 1 at the center thereof. The insulation case 1 accomodates an ignition coil 16 comprising a primary coil 4 and a secondary coil 6. The iron core 2 of an ignition apparatus having a gap 2*a* extends through the hole 1*b*. The primary coil 4 is disposed to surround a portion of the iron core 2. The primary coil 4 is arranged such that a primary coil winding 4*a* is wound around a primary bobbin 3. A secondary bobbin 5 is disposed around the outer periphery of the primary coil 4 of the ignition coil and a secondary coil winding 6*a* of the secondary coil 6 is wound around the secondary bobbin 5.

A power switch 7 is accommodated in an auxiliary accommodating unit 1*c* projecting from the accommodating unit 1*a*. The power switch 7 is composed of a power transistor 8 and an integrated circuit (IC) for driving and controlling the power transistor 8 which are sealed by a resin as solid members by insert molding. A heat sink 9 is fixed on the upper surface of the power switch 7 by screws 10.

The insulation case 1 includes holding portions 1*d*, 1*e* for a high-tension terminal as the high-tension unit of the ignition coil and a holding portion 1*f* for a low-tension terminal unit 11. A connector housing 1*g* is engaged with the holding portion 1*f* of the low-tension terminal unit 11. Note, the connector housing 1*g* is omitted in FIG. 5. There is disposed in the holding portion 1*f* a low-tension terminal assembly 12 which is integrated with the low-tension terminal unit 11 composed of a power supply terminal 11*a*, a signal terminal 11*b* and a ground terminal 11*c*.

The primary coil winding 4*a* has an end $4a_1$ which is wound around the tentative fastening portion 3*a* of the primary bobbin 3 and then the extreme end of which is wound around the power supply terminal 11*a* several times and soldered thereto. The other end $4a_2$ of the primary coil winding 4*a* is wound around a tentative fastening portion 3*a* and then the extreme end of which is wound around the terminal 7*a* of the power switch 7 and soldered thereto. The signal terminal 11*b* is electrically connected to the terminal 7*b* of the power switch 7 through a conductive wire 13*a*. This electric connection is effected such that both the ends of the conductive wire 13*a* are wound around the signal terminal 11*b* and the terminal 7*b* of the power switch 7 several times, respectively and then soldered thereto. The ground terminal 11*c* is electrically connected to the terminal 7*c* of the power switch 7 through a conductive wire 13*b*. Both the ends of the conductive wire 13*b* are also wound around the ground terminal 11*c* and the terminal 7*c* of the power switch 7 several times and then soldered thereto. The secondary coil winding 6*a* has an end connected to a high-tension terminal 14 and the other end connected to a high-tension terminal in the holding portion 1*d* of the secondary winding 6*a*. Note, the accommodating portion 1*a* and the auxiliary accommodating portion 1*c* of the insulation case 1 are filled with an insulating resin material 15 composed of a cured epoxy resin.

In the ignition apparatus for the internal combustion engine arranged as described above, the power switch 7 intermits a primary current flowing from the power supply terminal 11*a* to the primary coil 4, the power switch 7 and the ground terminal 11*c* in response to a signal input from an external control unit to the signal terminal 11*b*. When the primary current is shut off, a high-tension voltage is generated at the secondary coil 6 and output to an external ignition plug through the high-tension terminal 14.

Next, a sequence for assembling the ignition apparatus for the internal combustion engine arranged as described above will be described. First, an end of the primary bobbin 3 around which the primary coil winding 4*a* is wound is fixed to the surface of the insulation case 1 by ultrasonic fusion and then the secondary coil 6 composed of the secondary coil winding 6*a* wound around the secondary bobbin 5 is tentatively placed to the insulation case 1. Further, the power switch 7 to which the heat sink 9 is fixed by the screws 10 and the low-tension terminal assembly 12 are disposed in the auxiliary accommodating portion 1*c*.

Next, after the insulation coating of the both ends $4a_1$, $4a_2$ of the primary coil winding 4*a* wound around the tentatively fastening portion 3*a* are removed at the extreme ends thereof, the primary coil winding 4*a* is tentatively fastened to the power supply terminal 11*a* and the terminal 7*a* of the power switch 7 by hand at the extreme ends thereof, respectively. The conductive wires 13*a*, 13*b* are also tentatively fastened to the terminals 7*b*, 7*c* of the power switch 7, the signal terminal 11*b* and the ground terminal 11*c* by hand at both the ends thereof, respectively. Thereafter, the tentatively fastened portions are soldered, respectively.

Next, the connector housing 1*g* is mounted to the auxiliary accommodating portion 1*c*. This mounting job is carried out after the power supply terminal 11*a*, signal terminal 11*b* and ground terminal 11*c* are tentatively fastened and soldered to prevent the mounting job from interrupting the fastening and soldering jobs.

Next, the iron core 2 is mounted to the primary bobbin 3, then the insulation case 1 is filled with the insulating resin material 15 with its opening side facing upward and the insulating resin material 15 is heated and cured in a furnace.

In the conventional ignition apparatus for the internal combustion engine, when a primary current is fed to the power transistor 8 of the power switch 7, a voltage drops between the collector and the emitter of the power transistor 8 and heat is generated. Unless the heat is properly radiated, the power transistor 8 fails. To cope with this problem, the heat sink 9 must be in contact with the radiating portion of the power switch 7 under a sufficient pressure and the screws 10 are used as tightening devices for this purpose. Thus, there is a problem that the tightening devices are required, a manday is increased for a tightening job and a manufacturing cost is increased accordingly.

There is also a problem that a space for accommodating the heads of the screws 10 is necessary, the thickness of the heat sink 9 must be increased to a certain extent to cut screw threads to it and thus the size of the auxiliary accommodating portion 1*c* of the insulation case 1 is increased.

After the primary coil 4, secondary coil 6 and low-tension terminal assembly 12 are placed in the insulating case 1, respectively, the job for tentatively fastening the one end $4a_1$ and the other end $4a_2$ of the primary coil winding 4*a* and the conductive wires 13*a*, 13*b* at respective predetermined locations and soldering them must be carried out by hand, thus there is a problem that a working time and a manufacturing cost is increased.

Further, there is also a problem that a working space is required for the tentative fastening job and soldering job, the area of the opening of the insulation case 1 is increased and the size of the apparatus cannot be reduced as a whole.

SUMMARY OF THE INVENTION

An object of the present invention made to solve the above problems is to provide an ignition apparatus for an internal combustion engine and a manufacturing method of it by which a manufacturing cost can be reduced as well as the size of the ignition apparatus can be reduced.

An ignition apparatus for an internal combustion engine comprises: an ignition coil; a power switch for intermittently feeding a primary current to the ignition coil; a heat sink contacted with the power switch for radiating heat generated by said power switch; an insulation case accommodating the ignition coil, the power switch and the heat sink; wherein the power switch is elastically engaged with said heat sink.

Further, an ignition apparatus for an internal combustion engine comprises: an ignition coil; a power switch for intermittently feeding a primary current to the ignition coil; a low-tension terminal assembly having terminals electrically connected to the ignition coil and the power switch; an insulation case accommodating the ignition coil, the power switch and the low-tension terminal assembly; wherein the low-tension terminal assembly includes a frame member for positioning the power switch so that when the power switch comes into contact with the frame member, the terminals of said power switch abut against the terminals of the low-tension terminal assembly.

Further, a method of manufacturing an ignition apparatus for an internal combustion engine comprises the steps of: mounting a vessel-shaped heat sink to a power switch for intermittently feeding a primary current to an ignition coil; engaging a power switch assembly composed of the power switch covered with the heat sink, with a low-tension terminal assembly having terminals electrically connected to a primary coil of the ignition coil and the power switch by moving them in a straight line as well as connecting terminals of the power switch to the terminals of the low-tension terminal assembly; and engaging a primary coil assembly having a primary coil winding which is wound around a primary bobbin and has both ends extending perpendicularly with respect to the primary bobbin with said low-tension terminal assembly by moving them in a perpendicular direction with respect to the straight line as well as connecting both the ends of the primary coil winding to the terminals of the low-tension terminal assembly, respectively.

Further, a method of manufacturing an ignition apparatus for an internal combustion engine comprises the steps of: accommodating a power switch into the frame member of a low-tension terminal assembly having terminals electrically connected to a primary coil of an ignition coil and the power switch as well as connecting terminals of the power switch to the terminals of the low-tension terminal assembly; mounting a heat sink to the frame member by moving the heat sink; and engaging a primary coil assembly having a primary coil winding which is wound around a primary bobbin and has both ends extending perpendicularly with respect to the primary bobbin with the low-tension terminal assembly by moving them as well as connecting both the ends of the primary coil winding to the terminals of the low-tension terminal assembly, respectively.

DESCRIPTION OF PREFERRED EMBODIMENTS

EMBODIMENT 1

Figure 1:
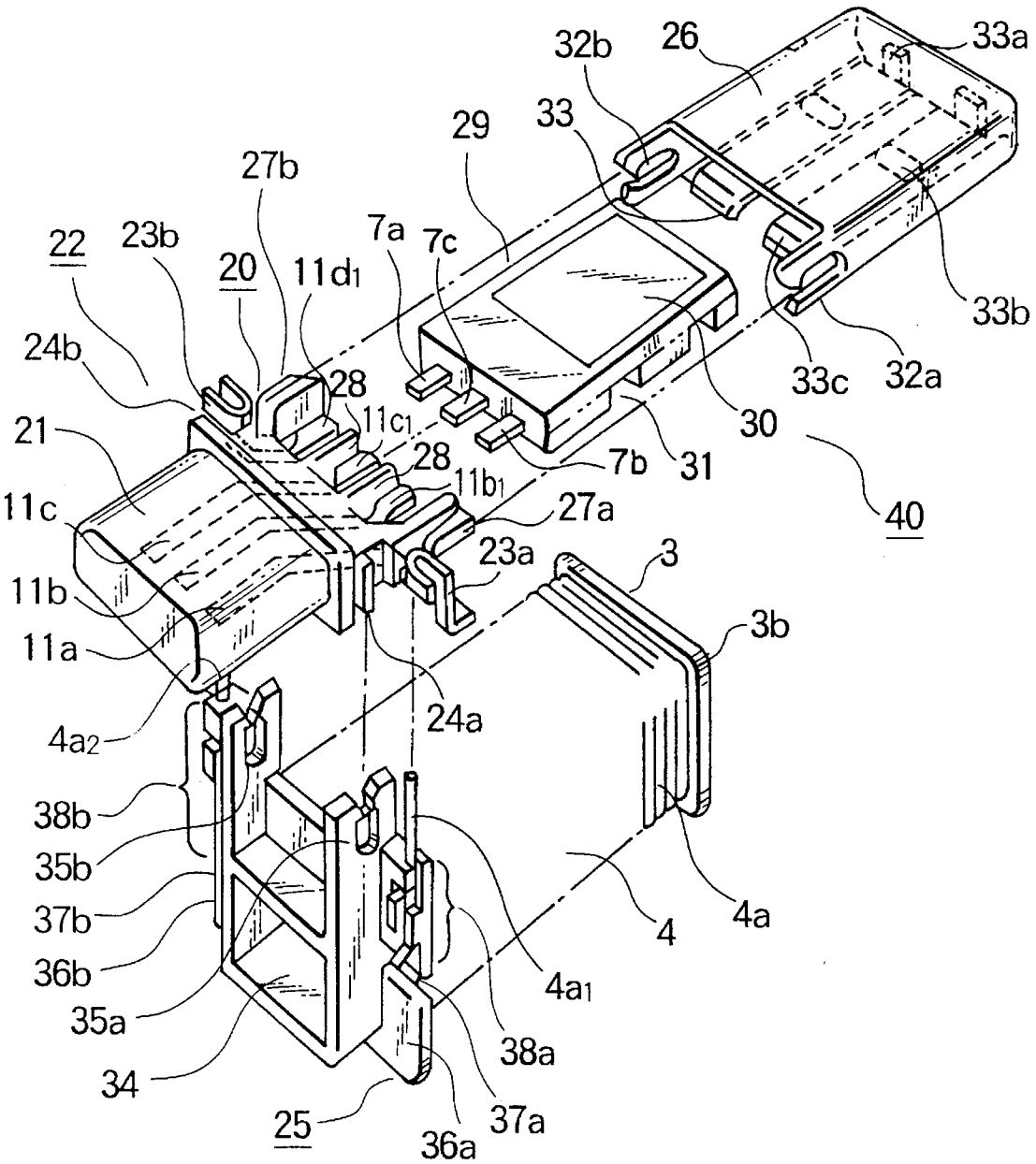
FIG. 1 is an exploded perspective view showing an embodiment of an ignition apparatus for an internal combustion engine according to the present invention.
Figure 2:
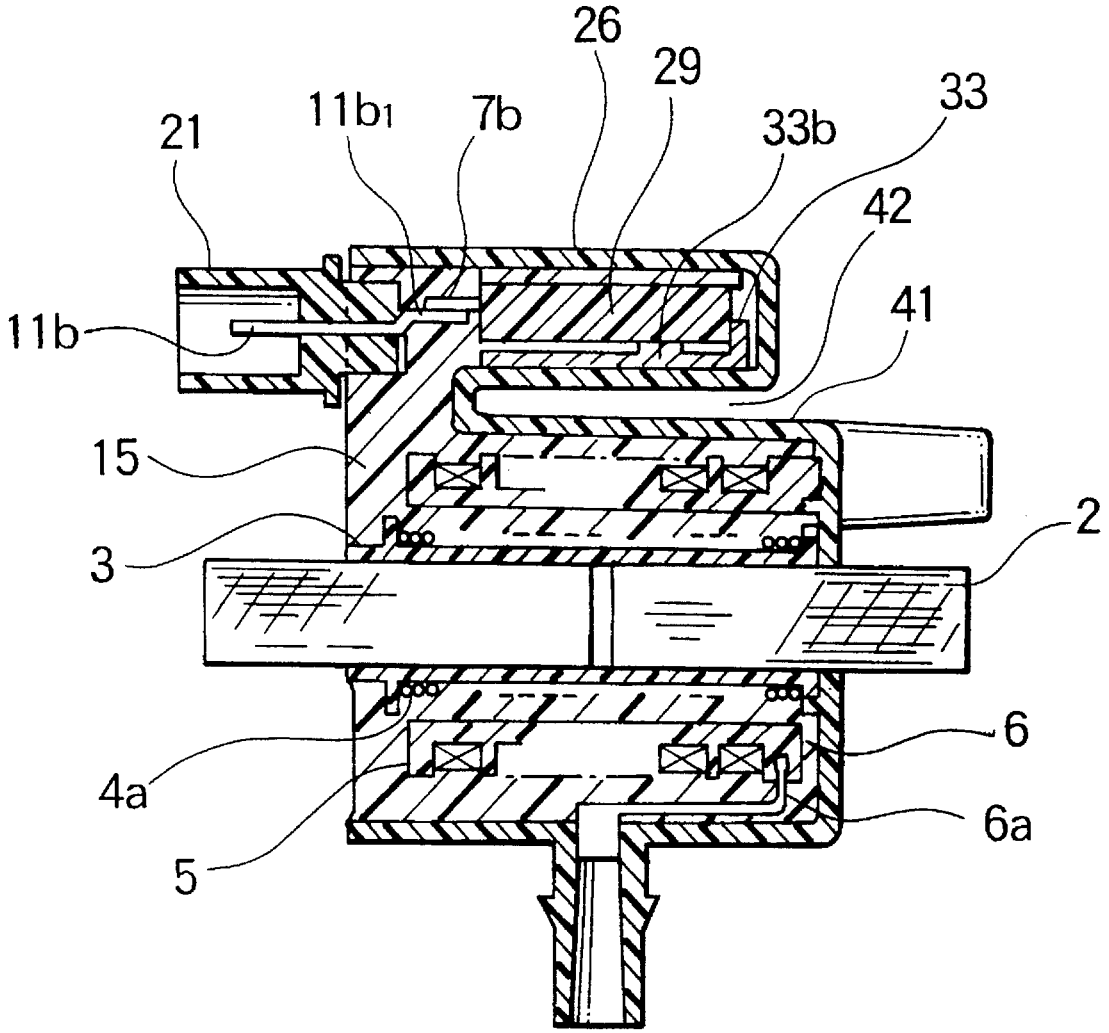
FIG. 2 is a sectional view of the ignition apparatus for an internal combustion engine of FIG. 1.
Figure 5:
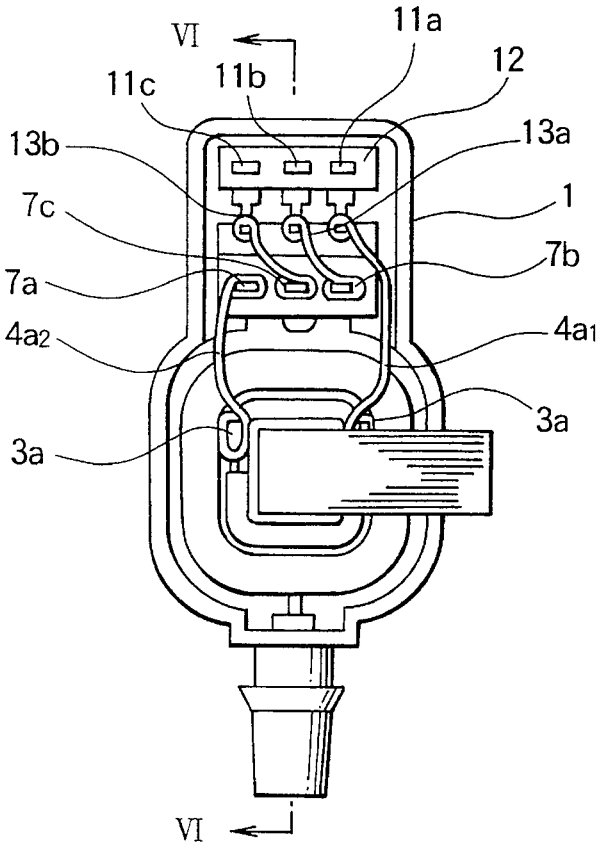
FIG. 5 PRIOR ART
FIG. 5 is a side elevational view of a conventional ignition apparatus for an internal combustion engine.
Figure 6:
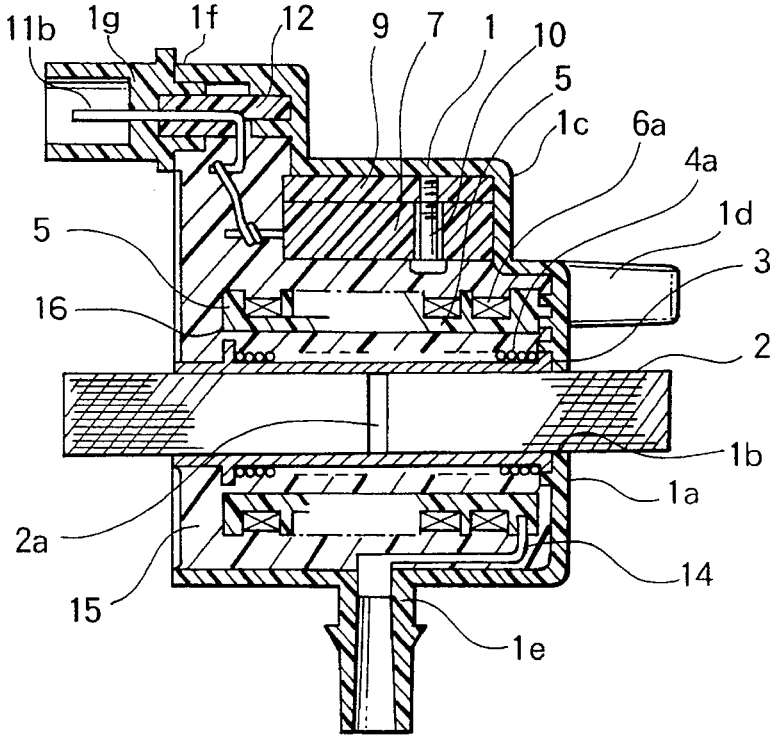
FIG. 6 PRIOR ART
FIG. 6 is a cross sectional view taken along line VI—VI of FIG. 5.
Figure 7:
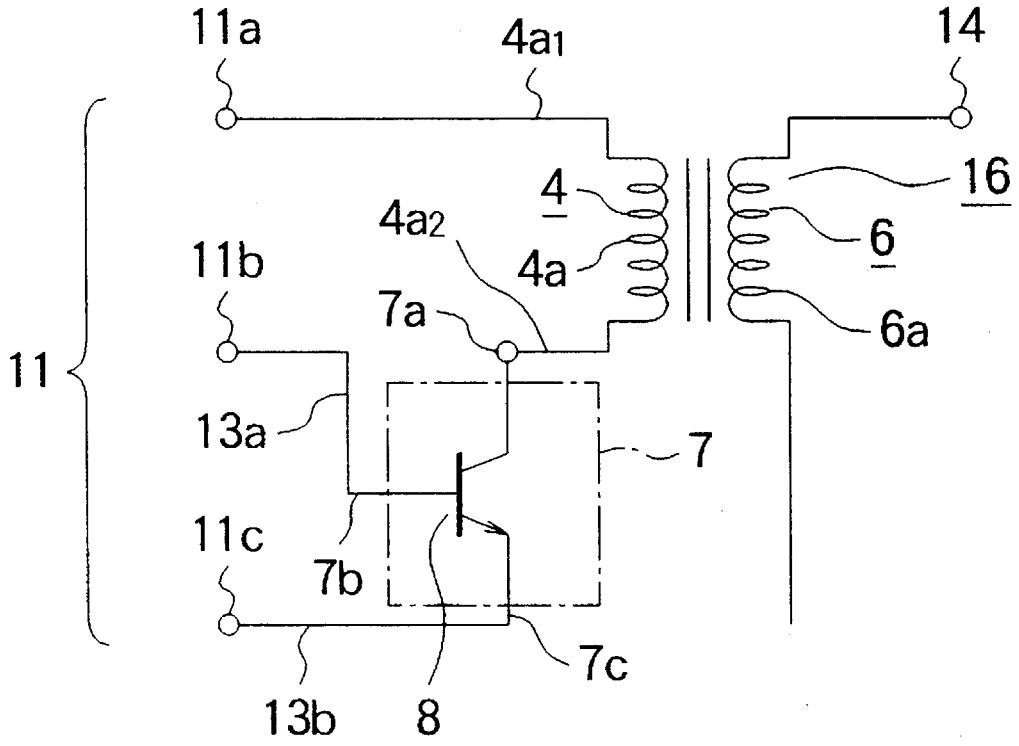
FIG. 7 PRIOR ART
FIG. 7 is an electric circuit diagram of the ignition apparatus for an internal combustion engine.

Embodiments of the present invention will be described below with reference to the drawings. FIG. 1 is an exploded perspective view showing an embodiment of an ignition apparatus for an internal combustion engine according to the present invention and FIG. 2 is a cross sectional view of the ignition apparatus for internal combustion engine of FIG. 1, wherein the same numeral as used in FIG. 5 to FIG. 7 are used to denote the same or corresponding parts and the description thereof is omitted.

In the drawings, a low-tension terminal assembly 20, which is composed by insert molding of a power supply terminal 11*a*, a signal terminal 11*b* and a ground terminal 11*c*, is integrated with a connector housing 21, and a low-tension terminal block 22 is composed of the low-tension terminal assembly 20 and the connector housing 21. U-shaped connecting terminals 23*a*, 23*b* to be connected to one end $4a_1$ and the other end $4a_2$ of a primary coil winding 4*a* are disposed on the both sides of the low-tension terminal assembly 20, respectively. Further, primary bobbin locking portions 24*a*, 24*b* to which a primary coil assembly 25 can be locked are disposed on both the sides of the low-tension terminal assembly 20. In addition, heat sink locking portions 27*a*, 27*b* to which a heat sink 26 can be locked are disposed on both the sides of the low-tension terminal assembly 20. The connector $11b_1$ of the signal terminal 11*b* at the extreme end thereof, the connector $11c_1$ the ground terminal 11*c* at the extreme end thereof and a connector $11d_1$ to be connected to the other end $4a_2$ of the primary coil winding 4*a* through the connecting terminal 23*b* are partitioned by walls 28, respectively.

A power switch 29 having terminals 7*a*, 7*b*, 7*c* to be connected to the connectors $11d_1$, $11b_1$, $11c_1$ is composed of a power transistor 8 (see FIG. 7) mounted on a metal radiation plate 30 whose one surface is exposed and a hybrid integrated circuit (hybrid IC) for driving and controlling the power transistor 8, the power transistor 8 and the hybrid integrated circuit being sealed by a resin as solid members by insert molding. A recess 31 is formed on the backside of the power switch 29. The recess 31 is formed of an insert member on which the power transistor 8 and hybrid integrated circuit are mounted when the power switch 29 is formed by the insert molding.

The vessel-shaped heat sink 26 for covering the power switch 29 has portions 32*a*, 32*b* formed on both the sides at the extreme ends thereof which are to be locked by the locking portions 27*a*, 27*b*. A press plate 33 formed on the bottom of the heat sink 26 has a stopper 33*a*, a convex portion 33*b* and a tapered portion 33*c* and is used as a press member for preventing the power switch 29 from coming out from the heat sink 26. The heat sink 26 is in contact with the inner surface of an insulation case 41 on the lower surface thereof, the insulation case 41 having an air space 42 communicating with the outside air formed thereto. The heat sink 26 is also in contact with the inner surface of the insulation case 41 on the upper surface thereof.

A locking member 34 for the primary coil assembly 25 is disposed on the side thereof opposite to the flange 3*b* of a primary bobbin 3. The primary coil assembly 25 has the locking member 34 which has recesses 35*a*, 35*b* formed at the upper end thereof which are to be elastically locked by the locking portions 24*a*, 24*b*. Collar portions 36*a*, 36*b* are disposed on both the sides of the locking member 34. Space portions 37*a*, 37*b* are formed on the collar portions 36*a*, 36*b* and tentative fastening portions 38*a*, 38*b* are disposed on the space portions 37*a*, 37*b*. The one end $4a_1$ of the primary coil winding 4*a* extends through the space portion 37*a*, is tentatively fastened by the tentative fastening portion 38*a* and guided to the connecting terminal 23*a* on the side of a power supply. Further, the other end $4a_2$ of the primary coil winding 4*a* extends through the space portion 37*b* and is tentatively fastened by the tentative fastening portion 38*b* and guided to the connecting terminal 23*b* on the side of the power switch 29.

Next, an assembly sequence of the ignition apparatus for the internal combustion engine arranged as described above will be described. First, the power switch 29 is inserted under pressure into the heat sink 26 against the elastic force of the press plate 33 to arrange a power switch assembly 40 integrally composed of the heat sink 26 and the power switch 29. Thereafter, the heat sink locking portions 27*a*, 27*b* elastically locked to the portions 32*a*, 32*b* to integrate power switch assembly 40 with the low-tension terminal blok 22. 22. Next, the terminals 7*a*, 7*b*, 7*c* which are vertically overlapped with the connectors $11d_1$, $11b_1$, $11c_1$ are held between welding electrodes from the upper side and lower side thereof and the terminals 7*a*, 7*b*, 7*c* are connected to the connectors $11d_1$, $11b_1$, $11c_1$ by welding.

Thereafter, the locking potions 24*a*, 24*b* are locked to the recesses 35*a*, 35*b* formed at the upper end of the locking member 34 to integrate the low-tension terminal block 22 with the primary coil assembly 25. When they are integrated with each other, the one end $4a_1$ of the primary coil winding 4*a* is guided to the U-shaped connecting terminal 23*a* and the other end $4a_2$ of the primary coil winding 4*a* is guided to the U-shaped connecting terminal 23*b*. Next, the connecting terminals 23*a*, 23*b* are attached under pressure to the one end $4a_1$ and the other end $4a_2$ of the primary coil winding 4*a* to electrically connect the primary coil 4 to the power supply terminal 11*a* and the primary coil 4 to the power switch 29.

In the ignition apparatus for the internal combustion engine arranged as described above, the power switch 29 is inserted under pressure into the heat sink 26 against the elastic force of the press plate 33 and fixed therein, and a predetermined contact force is secured between the metal radiation plate 30 of the power switch 29 and the heat sink 26. Therefore, fastening devices such as the screws 10 or the like which are conventionally needed to fix the power switch 7 to the heat sink 9 are not required, so that a manufacturing cost is reduced by the reduction of the number of parts and the manday for a fastening job are reduced.

Further, since a space for accommodating the heads of the screws 10 and the thickness of the heat sink 26 for cutting screw holes are not necessary, the thickness of the walls of the heat sink 26 can be reduced.

Since the heat sink 26 is formed to the vessel shape and covers the circumference of the power switch 29, and the heat radiation area of the heat sink 26 can be increased, a temperature increase caused by heat generated by a primary current flowing to the power transistor 8 can be suppressed, and the reliability of the power switch 29 can be secured.

One surface of the heat sink 26 is in contact with the inner surface of the insulation case 41, and the other surface of the heat sink 26 is also in contact with the inner surface of the insulation case 41 to which the air space 42 communicating with the outside air is formed, so that the area of the heat sink 26 which indirectly comes into contact with the outside air is increased, and heat from the power switch 29 is effectively discharged through the heat sink 26.

The low-tension terminal block 22 and the power switch assembly 40 have the locking portions 27*a*, 27*b* and portions 32*a*, 32*b* to be locked, respectively. Further, the respective terminals 7*a*, 7*b*, 7*c* of the power switch 29 are in parallel with the connectors $11d_1$, $11b_1$, $11c_1$. Therefore, the low-tension terminal block 22 can be simply assembled with the power switch assembly 40 by linearly moving them. At this time, since the terminals 7*a*, 7*b*, 7*c* are abutted against the connectors $11d_1$, $11b_1$, $11c_1$, respectively, it suffices only to connect the terminals 7*a*, 7*b*, 7*c* to the connectors $11d_1$, $11b_1$, $11c_1$ by holding and welding them between the welding electrodes from the upper side and the lower side thereof thereafter. That is, no man power is needed for the alignment of them, so that a job is simplified.

Since the locking portions 24*a*, 24*b* are locked to the recesses 35*a*, 35*b* by perpendicularly moving the primary coil assembly 25 with respect to the low-tension terminal block 22, the low-tension terminal block 22 can be simply assembled to the primary coil assembly 25. Since the one end $4a_1$ and the other end $4a_2$ of the primary coil winding 4*a* are inserted into the connecting terminals 23*a*, 23*b*, it suffices only to attach the connecting terminals 23*a*, 23*b* under pressure.

As described above, the low-tension terminal block 22, the power switch assembly 40 and the primary coil assembly 25 can be simply assembled to each other in such a manner that the power switch assembly 40 is horizontally moved with respect to the low-tension terminal block 22 and the primary coil assembly 40 is vertically moved with respect to the low-tension terminal block 22. Therefore, the alignment and the abutment of the terminals 7*a*, 7*b*, 7*c* against the connectors $11d_1$, $11b_1$, $11c_1$ and the alignment and the insertion of the one end $4a_1$ and the other end $4a_2$ of the primary coil winding 4*a* to the connecting terminals 23*a*, 23*b* are automatically effected, allowing the assembly and connection jobs to be automated.

Since the low-tension terminal block 22, power switch assembly 40 and primary coil assembly 25 are not separated each other by vibration and the like applied thereto in the transportation of them after they are assembled, the assembly process of the present invention need not be effected on the final process line of the manufacture of the ignition apparatus for the internal combustion engine but may be effected, for example, on a separate manufacturing line. Therefore, a range of selection of an assembly process can be increased, which results in the reduction of an assembly cost.

Further, since the electric connection of the terminals 7*a*, 7*b*, 7*c* to the connectors 11*d*$_1$, 11*b*$_1$, 11*c*$_1$ and the electric connection of the connecting terminals 23*a*, 23*b* to the one end 4*a*$_1$ and the other end 4*a*$_2$ of the primary coil winding 4*a* need not be effected in the insulation case 41, the area of the opening of the insulation case 41 need not be increased, by which the size of the ignition apparatus for the internal combustion engine can be reduced as a whole.

EMBODIMENT 2

Figure 3:
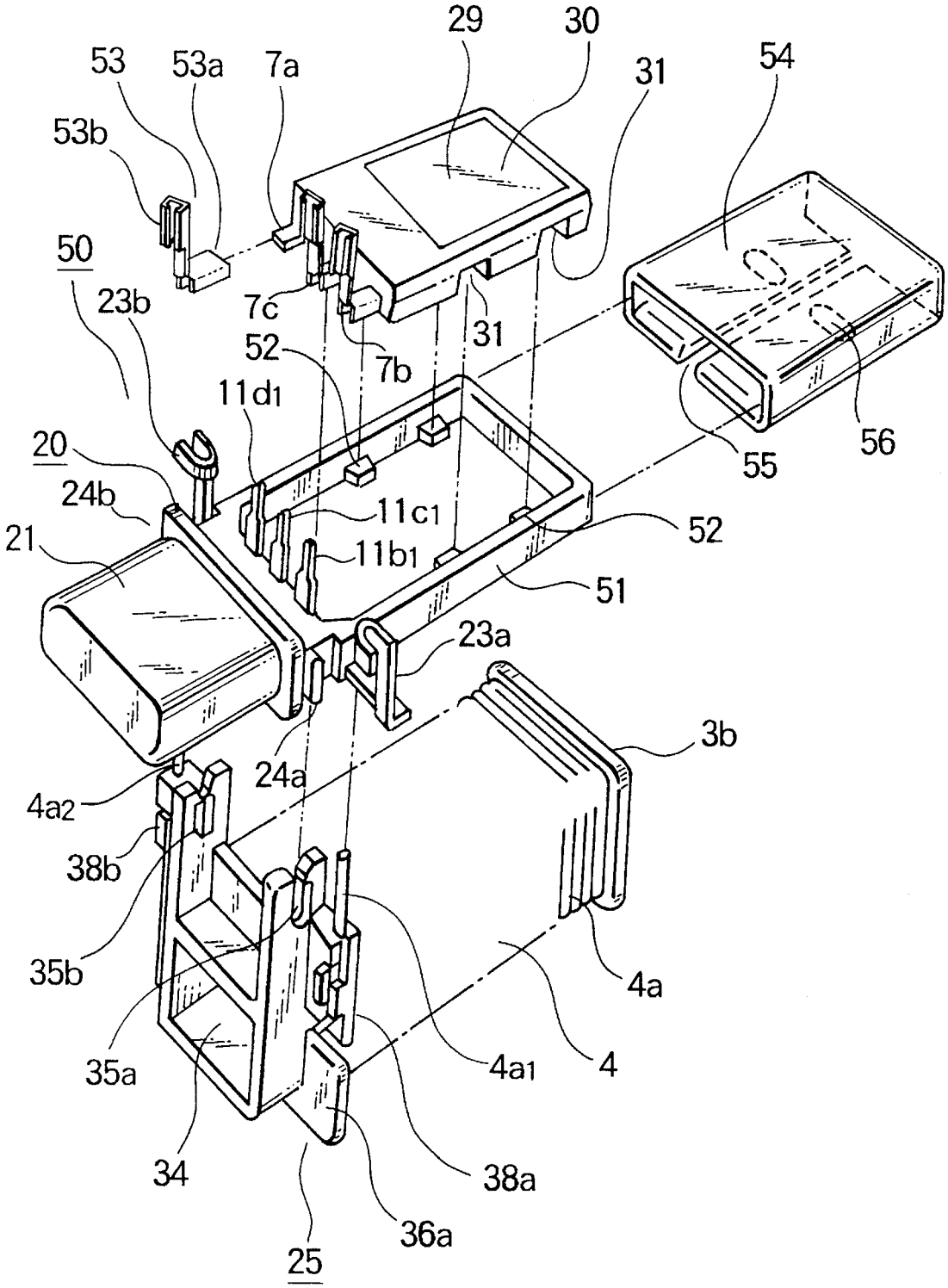
FIG. 3 is an exploded perspective view showing another embodiment of the ignition apparatus for an internal combustion engine according to the present invention.

FIG. 3 is an exploded perspective view showing another embodiment or an embodiment 2 of the ignition apparatus for the internal combustion engine according to the present invention, wherein a low-tension terminal assembly 20 to which a power supply terminal 11*a*, a signal terminal 11*b* and a ground terminal 11*c* are insert molded has a frame member 51. The low-tension terminal assembly 20 is integrated with a connector housing 21 to constitute a low-tension terminal block 50. A U-shaped connecting terminals 23*a*, 23*b* to be connected to the one end 4*a*$_1$ and the other end 4*a*$_2$ of a primary coil winding 4*a* are disposed on both the sides of the low-tension terminal assembly 20, respectively. Further, locking portions 24*a*, 24*b* by which locking to a primary coil assembly 25 is enabled are disposed on both the side of the low-tension terminal assembly 20. Projections 52 are formed on the inside of the frame member 51 and a power switch 29 is fixed to the low-tension terminal block 50 by the engagement of the projections 52 with the recesses 31 of the power switch 29.

The power switch 29 has terminals 7*a*, 7*b*, 7*c* connected to connectors 11*d*$_1$, 11*b*$_1$, 11*c*$_1$ through a spare terminal 53, respectively. The spare terminal 53 has a first connecting portion 53*a* formed to one end thereof, the terminals 7*a*, 7*b*, 7*c* being inserted into the connecting portion 53*a* under pressure and welded thereto. Further, the spare terminal 53 has a second connecting portion 53*b* formed to the other end thereof, the connectors 11*d*$_1$, 11*b*$_1$, 11*c*$_1$ being inserted into the connecting portion 53*b* and welded or soldered thereto.

A slit 55 is formed on the bottom of a heat sink 54 covering the power switch 29. Further, projections 56 are formed on the bottom of the heat sink 54 having a C-shaped cross secton to prevent the power switch 29 from coming out from the heat sink 54 as well as provide a predetermined contact pressure between the heat sink 54 and the metal radiation plate 30 of the power switch 29.

Next, an assembly sequence of the ignition apparatus for internal the combustion engine arranged as described above will be described. First, the power switch 29 whose terminals 7*a*, 7*b*, 7*c* are engaged with the spare terminal 53 is placed within the frame member 51. At this time, the second connecting portion 53*b* of the spare terminal 53 is automatically aligned and engaged with the connectors 11*d*$_1$, 11*b*$_1$, 11*c*$_1$. Thereafter, the heat sink 54 is inserted under pressure into the low-tension terminal block 50 integrated with the power switch 29 so as to apply the predetermined contact pressure to the heat sink 54 with respect to the metal radiation plate 30. Thereafter, the locking portions 24*a*, 24*b* are elastically locked into recesses 35*a*, 35*b* formed at the upper end of the locking member 34 so that the low-tension terminal block 50 is integrated with the primary coil assembly 25.

When they are integrated with each other, the one end 4*a*$_1$ of the primary coil winding 4*a* is automatically guided to the U-shaped connecting terminal 23*a*, the other end 4*a*$_2$ of the primary coil winding 4*a* is automatically guided to the U-shaped connecting terminal 23*b* and thereafter the connecting terminals 23*a*, 23*b* are attached to the one end 4*a*$_1$ and the other end 4*a*$_2$ of the primary coil 4*a* under pressure.

Thereafter, the portions where the terminals 7*a*, 7*b*, 7*c* are electrically connected to the connectors 11*d*$_1$, 11*b*$_1$, 11*c*$_1$ and the portions where the connecting terminals 23*a*, 23*b* are electrically connected to the one end 4*a*$_1$ and the other end 4*a*$_2$ of the primary coil winding 4*a* are dipped into a dip solder bath and soldered.

The embodiment 2 can achieve the same advantage as that of the embodiment 1 as well as the connected portions can be soldered at the same time.

EMBODIMENT 3

Figure 4:
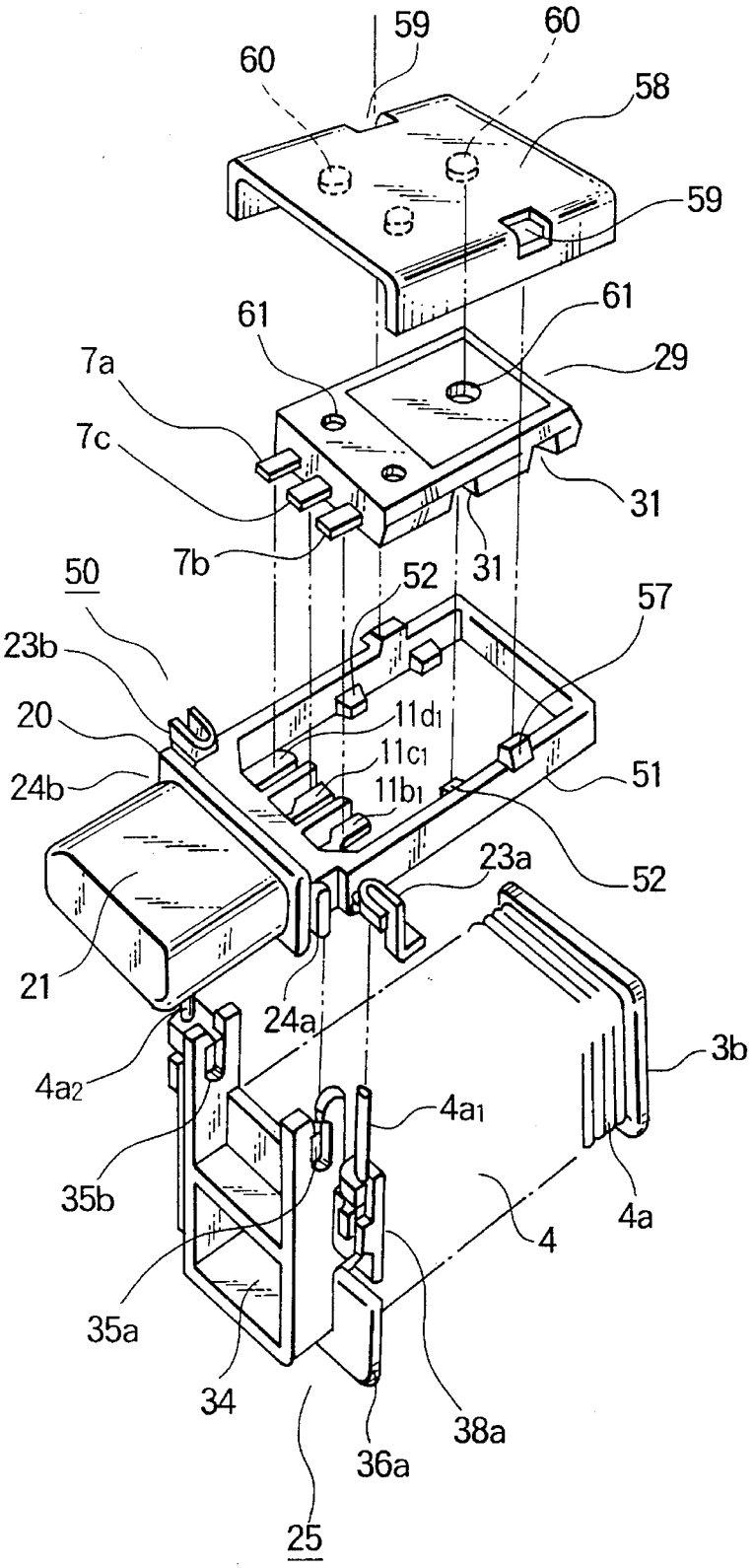
FIG. 4 is an exploded perspective view showing still another embodiment of the ignition apparatus for an internal combustion engine according to the present invention.

FIG. 4 is an exploded perspective view showing still another embodiment or an embodiment 3 of the ignition apparatus for internal combustion engine according to the present invention, wherein a low-tension terminal assembly 20 to which a power supply terminal 11*a*, a signal terminal 11*b* and a ground terminal 11*c* are insert molded has a frame member 51. The low-tension terminal assembly 20 is integrated with a connector housing 20 to constitute a low-tension terminal block 50. A U-shaped connection terminals 23*a*, 23*b* to be connected to the one end 4*a*$_1$ and the other end 4*a*$_2$ of a primary coil winding 4*a* are disposed on both the sides of the low-tension terminal assembly 20, respectively. Further, primary bobbin locking portions 24*a*, 24*b* by which locking to the primary coil assembly 25 is enabled are disposed on both the side of the low-tension terminal assembly 20. Projections 52 are formed on the inside of the frame member 51 and the low-tension terminal block 50 is fixed to a power switch 29 by the engagement of the projections 52 with the recesses 31 of the power switch 29. Further, locking portions 57 which can be locked to a heat sink 58 are formed on the upper end surface of the frame member 51.

The heat sink 58 covering the upper surface of the power switch 29 has holes 59 defined thereto which are to be engaged with the engaging portions 57. The heat sink 58 having a C-shaped cross section also has projections 60 defined on the back surface thereof, the projections 60 being engaged with recesses 61 formed on the surface of the power switch 29. The heat sink 58 is integrated with the power switch 29 by using an adhesive having a high coefficient of heat transfer.

When the ignition apparatus for the internal combustion engine is assembled in the embodiment 3, the power switch 29 integrated with the heat sink 58 by the adhesive is inserted into the frame member 51. At this time, the terminals 7*a*, 7*b*, 7*c* are self-aligned and abutted against the connectors 11*d*$_1$, 11*b*$_1$, 11*c*$_1$. The projections 52 are engaged with the recesses 31 of the power switch 29 and the locking portions 57 are elastically locked to the holes 59, so that the low-tension terminal block 50, power switch 29 and heat sink 58 are integrated with each other.

Further, a series of assembly jobs can be effected by vertically moving the respective assembly members, thus the assembly jobs can be simplified.

What is claimed is:

1. An ignition apparatus for an internal combustion engine comprising:

an ignition coil;

a power switch for intermittently feeding a primary current to said ignition coil;

a heat sink contacted with said power switch for radiating heat generated by said power switch;

an insulation case accommodating said ignition coil, said power switch and said heat sink;

wherein said power switch is elastically engaged with said heat sink.

2. An ignition apparatus for an internal combustion engine according to claim 1, wherein said heat sink is vessel-shaped and said power switch is accommodated in said vessel-shaped heat sink.

3. An ignition apparatus for an internal combustion engine according to claim 1, wherein said power switch is caused to come into contact with said heat sink under pressure by a press member disposed to said heat sink.

4. An ignition apparatus for an internal combustion engine according to claim 2, wherein a surface of said heat sink comes into contact with the inner surface of said insulation case and the other surface of said heat sink comes into contact with the inner surface of said insulation case which is provided with an air layer connected with the outside air.

5. An ignition apparatus for an internal combustion engine comprising:

an ignition coil;

a power switch for intermittently feeding a primary current to said ignition coil;

a low-tension terminal assembly having terminals electrically connected to said ignition coil and said power switch;

an insulation case accommodating said ignition coil, said power switch and said low-tension terminal assembly;

wherein said low-tension terminal assembly includes a frame member for positioning said power switch so that when said power switch comes into contact with said frame member, the terminals of said power switch abut against the terminals of said low-tension terminal assembly.

6. An ignition apparatus for an internal combution engine according to claim 5, wherein said power switch is elastically engaged with a heat sink to radiate heat generated by said power switch.

7. An ignition apparatus for an internal combustion engine according to claim 5, wherein a spare terminal is engaged with the perpendicularly projecting terminal of said low-tension terminal assembly and the terminal of said power switch.

8. A method of manufacturing an ignition apparatus for an internal combustion engine, comprising the steps of:

mounting a vessel-shaped heat sink to a power switch for intermittently feeding a primary current to an ignition coil;

engaging a power switch assembly composed of said power switch covered with said heat sink with a low-tension terminal assembly having terminals electrically connected to said ignition coil and said power switch by moving them in a straight line as well as connecting terminals of said power switch to the terminals of said low-tension terminal assembly; and engaging a primary coil assembly having a primary coil winding which is wound around a primary bobbin and has both ends extending perpendicularly with respect to said primary bobbin with said low-tension terminal assembly by moving them in a perpendicular direction with respect to said straight line as well as connecting both the ends of said primary coil winding to the terminals of said low-tension terminal assembly, respectively.

9. A method of manufacturing an ignition apparatus for an internal combustion engine, comprising the steps of:

accommodating a power switch into the frame member of a low-tension terminal assembly having terminals electrically connected to a primary coil of an ignition coil and said power switch as well as connecting terminals of said power switch to the terminals of said low-tension terminal assembly;

mounting a heat sink to said frame member by moving said heat sink; and engaging a primary coil assembly having a primary coil winding which is wound around a primary bobbin and has both ends extending perpendicularly with respect to said primary bobbin with said low-tension terminal assembly by moving them as well as connecting both the ends of said primary coil winding to the terminals of said low-tension terminal assembly, respectively.

10. A method of manufacturing an ignition apparatus for an internal combustion engine according to claim 9, wherein said heat sink having a C-shaped cross section is elastically engaged with said frame member.

* * * * *